US009758280B2

(12) United States Patent
Goddard et al.

(10) Patent No.: US 9,758,280 B2
(45) Date of Patent: Sep. 12, 2017

(54) SQUEEZE TUBE AND METHOD OF MAKING A SQUEEZE TUBE

(71) Applicant: Berry Plastics Corporation, Evansville, IN (US)

(72) Inventors: John R Goddard, Haubstadt, IN (US); Bryan K Seibert, Haubstadt, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 14/753,871

(22) Filed: Jun. 29, 2015

(65) Prior Publication Data

US 2015/0375904 A1 Dec. 31, 2015

Related U.S. Application Data

(60) Provisional application No. 62/018,988, filed on Jun. 30, 2014.

(51) Int. Cl.

| | |
|---|---|
| ***B65D 35/00*** | (2006.01) |
| ***B65D 35/10*** | (2006.01) |
| ***B65D 35/44*** | (2006.01) |
| ***B31C 5/00*** | (2006.01) |

(52) U.S. Cl.

CPC ..... *B65D 35/10* (2013.01); *B31C 5/00* (2013.01); *B65D 35/44* (2013.01); *B31B 2201/88* (2013.01); *B31B 2201/9085* (2013.01); *B31B 2217/0084* (2013.01); *B31B 2217/062* (2013.01); *B31B 2217/082* (2013.01); *B65D 2203/00* (2013.01)

(58) Field of Classification Search

CPC ..... B65D 35/08; B65D 35/10; B65D 35/44; B65D 2203/00; B31B 2217/0084; B31B 2217/062; B31B 2217/082; B31C 5/00

USPC ..... 222/92, 106, 107; 206/277, 484, 484.2

See application file for complete search history.

(56) References Cited

U.S. PATENT DOCUMENTS

| | | | | |
|---|---|---|---|---|
| 570,728 | A * | 11/1896 | Goodwin | B29C 45/0025 264/279 |
| 2,383,230 | A * | 8/1945 | Voke | B65D 35/12 156/218 |
| 2,682,974 | A * | 7/1954 | Smith | B65D 35/10 156/190 |
| 2,980,963 | A * | 4/1961 | Makowski | B26D 3/16 264/132 |
| 3,458,087 | A | 7/1969 | Cox, Jr. | |
| 3,504,067 | A * | 3/1970 | Trecek | B29C 31/002 222/107 |

(Continued)

FOREIGN PATENT DOCUMENTS

FR 2377263 A1 8/1978

OTHER PUBLICATIONS

International Search Report and Written Opinion for International Application No. PCT/US2015/038343, Aug. 25, 2015, 8 pages.

*Primary Examiner* — Lien Ngo

(74) *Attorney, Agent, or Firm* — Barnes & Thornburg LLP

(57) ABSTRACT

A squeeze tube includes a fluid-discharge container and a fluid-discharge closure mated to the fluid-storage container. The fluid-discharge closure is coupled to one end of the fluid-storage container and configured to discharge selectively fluid stored in a product-storage region formed in the fluid-storage container.

20 Claims, 5 Drawing Sheets

(56) References Cited

U.S. PATENT DOCUMENTS

| | | | | | |
|---|---|---|---|---|---|
| 3,650,059 | A * | 3/1972 | Johnson | B29C 59/021 | 101/18 |
| 4,006,275 | A * | 2/1977 | Monia | B65D 35/00 | 222/92 |
| 5,238,642 | A | 8/1993 | Benquet | | |
| 5,322,658 | A | 6/1994 | Holoubek et al. | | |
| 5,383,373 | A * | 1/1995 | Knowles, Jr. | G01F 19/00 | 222/1 |
| 6,210,766 | B1 * | 4/2001 | McLaughlin | B65D 35/08 | 222/107 |
| 8,763,859 | B2 | 7/2014 | Cain | | |
| 2008/0247967 | A1 * | 10/2008 | Sagel | A61K 8/0237 | 424/49 |
| 2008/0247968 | A1 * | 10/2008 | Sagel | A61K 8/02 | 424/49 |
| 2013/0269550 | A1 * | 10/2013 | Wilen | G06Q 20/28 | 101/18 |

* cited by examiner

SQUEEZE TUBE AND METHOD OF MAKING A SQUEEZE TUBE

PRIORITY CLAIM

This application claims priority under 35 U.S.C. §119(e) to U.S. Provisional Application Ser. No. 62/018,988, filed Jun. 30, 2014, which is expressly incorporated by reference herein.

BACKGROUND

The present disclosure relates to tubes, and particularly to tubes for storing and discharging fluid materials. More particularly, the present disclosure relates to a squeeze tube made from plastics materials.

SUMMARY

According to the present disclosure, a squeeze tube includes a fluid-discharge container and a fluid-discharge closure mated to the fluid-storage container. The fluid-discharge closure is coupled to one end of the fluid-storage container and configured to discharge selectively fluid stored in a product-storage region formed in the fluid-storage container.

In illustrative embodiments, a process for making a squeeze tube includes providing a plastics-material sheet that is then embossed to provide an embossed sheet. The embossed sheet includes a non-embossed portion and an embossed portion that is arranged to extend away from the non-embossed portion. The embossed sheet is then used with a closure to form an open package ready for filling with products. After filling has occurred, a tail end of the package is closed and the squeeze tube is established.

In illustrative embodiments, the fluid-discharge container includes a side wall provided by the embossed sheet that includes the non-embossed portion and the embossed portion. In illustrative embodiments, the embossed portion is a raised embossment that is arranged to extend away from both the side wall and the product-storage region. In illustrative embodiments, the embossed portion is a recessed embossment that is arranged to extend into the product-storage region. In illustrative embodiments, the embossed portion is a combined embossment that includes both a raised portion arranged to extend away from the interior region and a recessed portion arranged to extend into the interior region.

In illustrative embodiments, the side wall, including the embossed portion, of the fluid-storage container are made from plastics materials. The plastics materials have a thickness of greater than about 0.01 inches. The embossed portion has a thickness which is less than about 0.050 inches.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figures 1, 2:
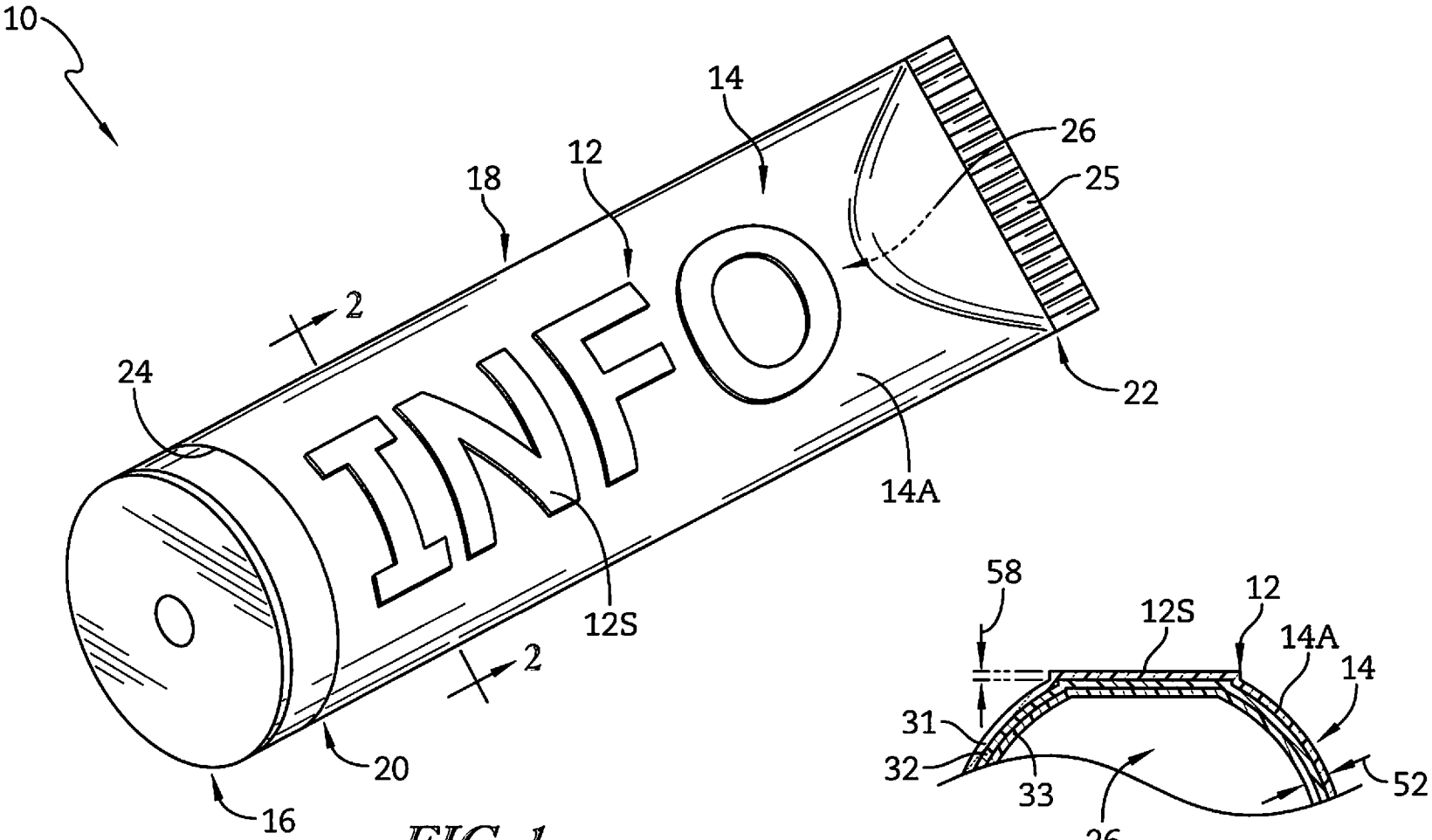
FIG. 1 is a perspective view of a first embodiment of squeeze tube in accordance with the present disclosure showing that the squeeze tube includes a fluid-discharge container and a fluid-discharge closure coupled to a head end of the fluid-storage container and that the fluid-storage container includes a raised embossment, shown as INFO, formed during a manufacturing process.
FIG. 2 is a sectional view taken along line 2-2 of FIG. 1 showing that the fluid-storage container is made from a three-layer laminate of plastics materials and that the raised embossment is coupled to a non-embossed portion of the side wall and extends through all the layers of the three-layer laminate.
Figure 3:
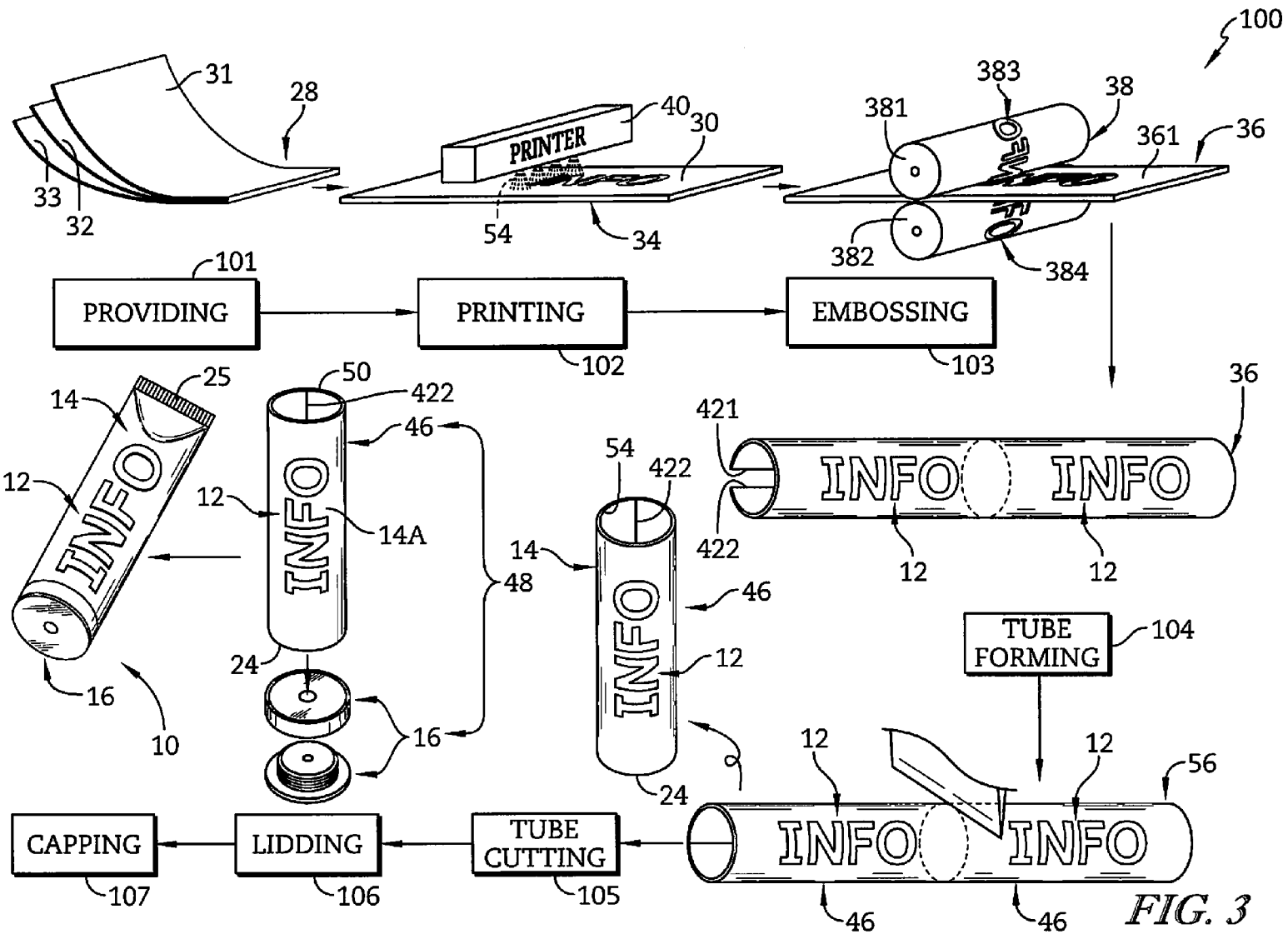
Figure 4:
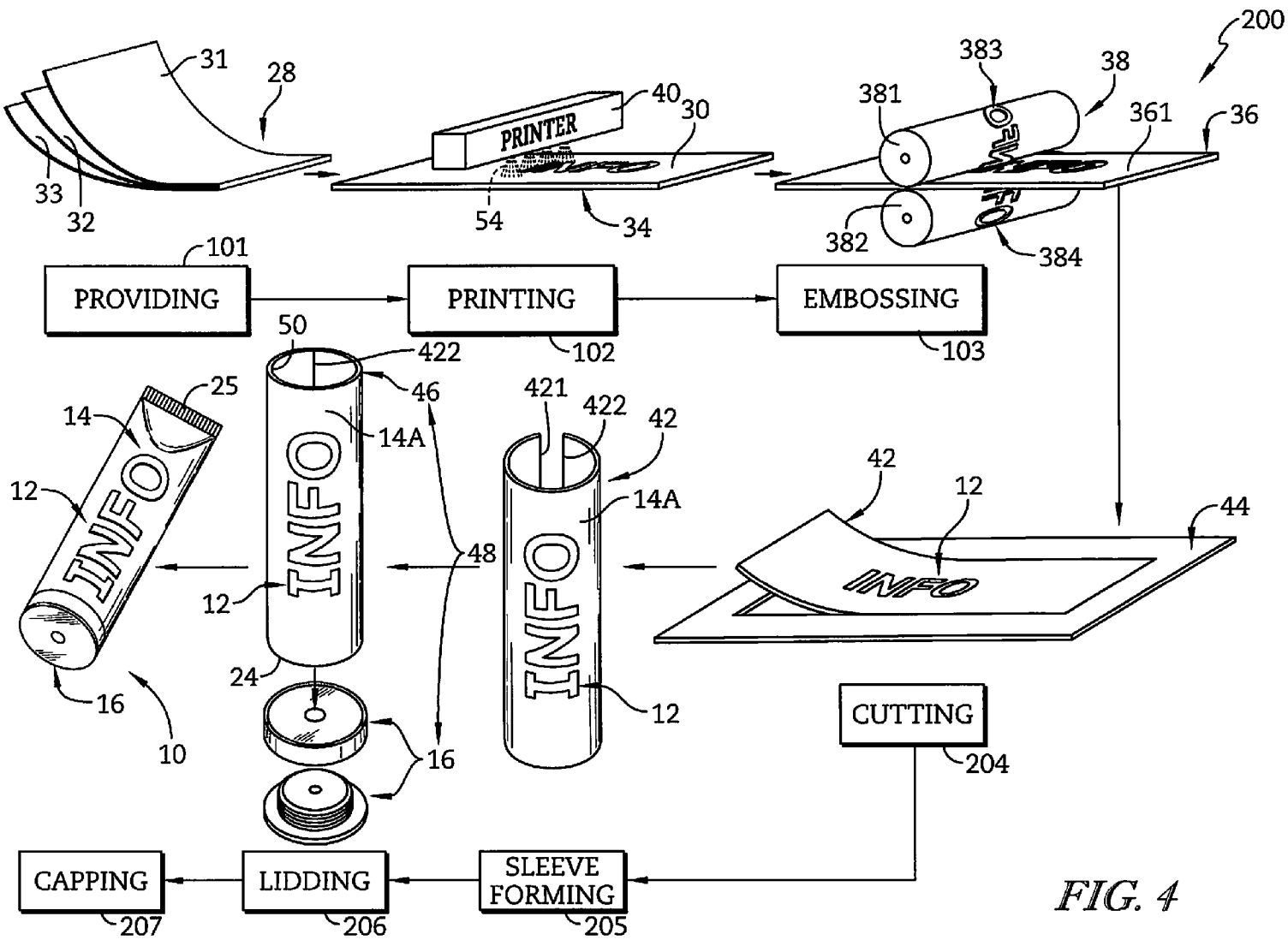
Figure 5:
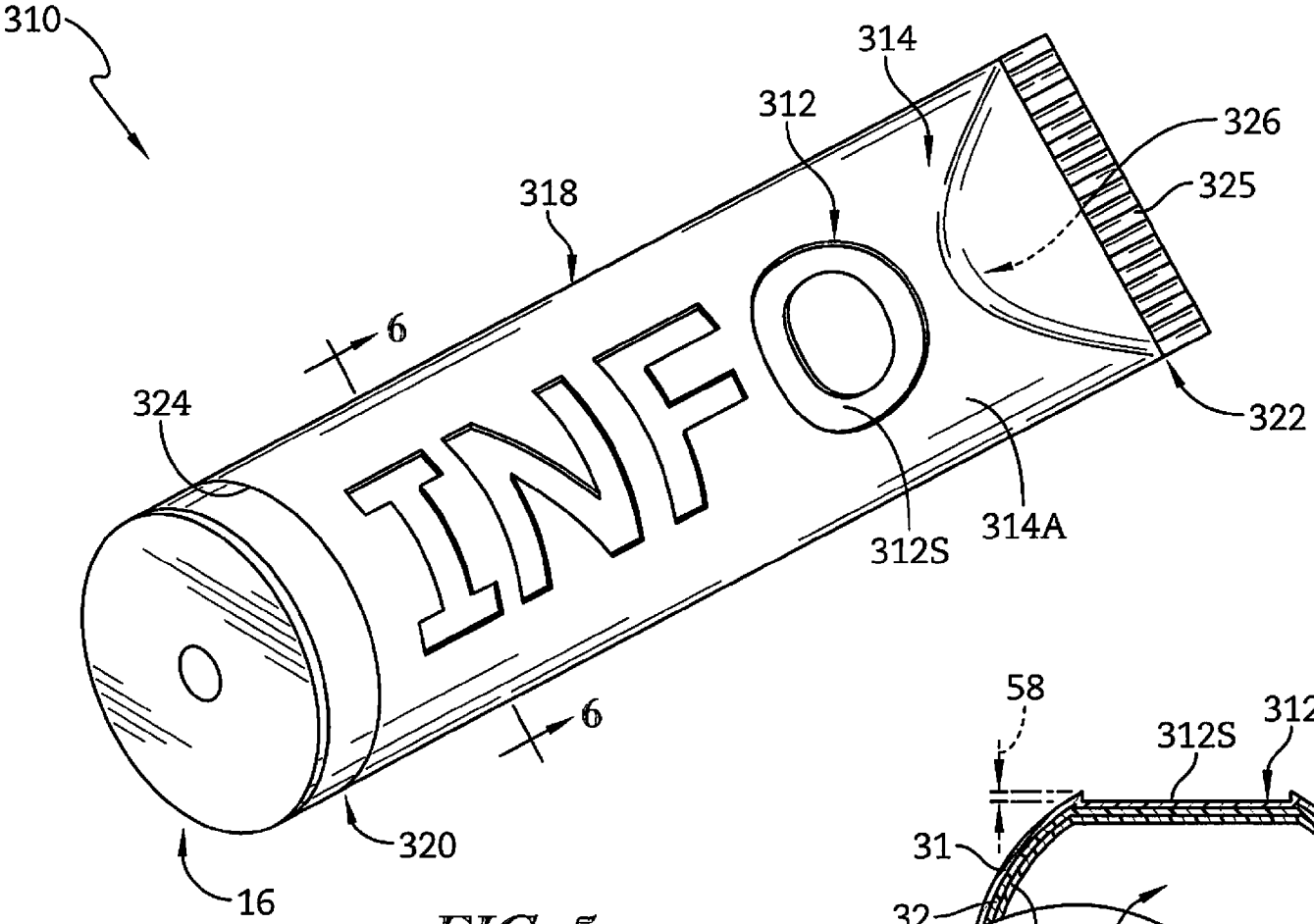
Figure 6:
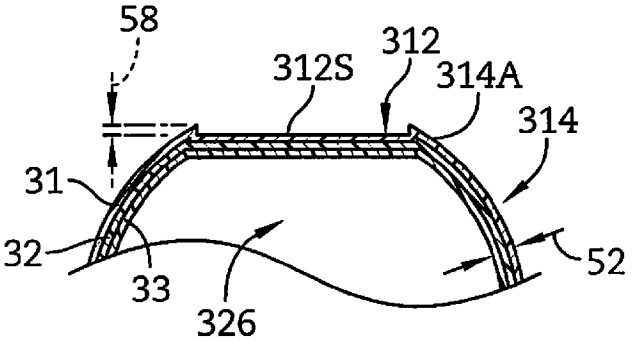
Figure 7:
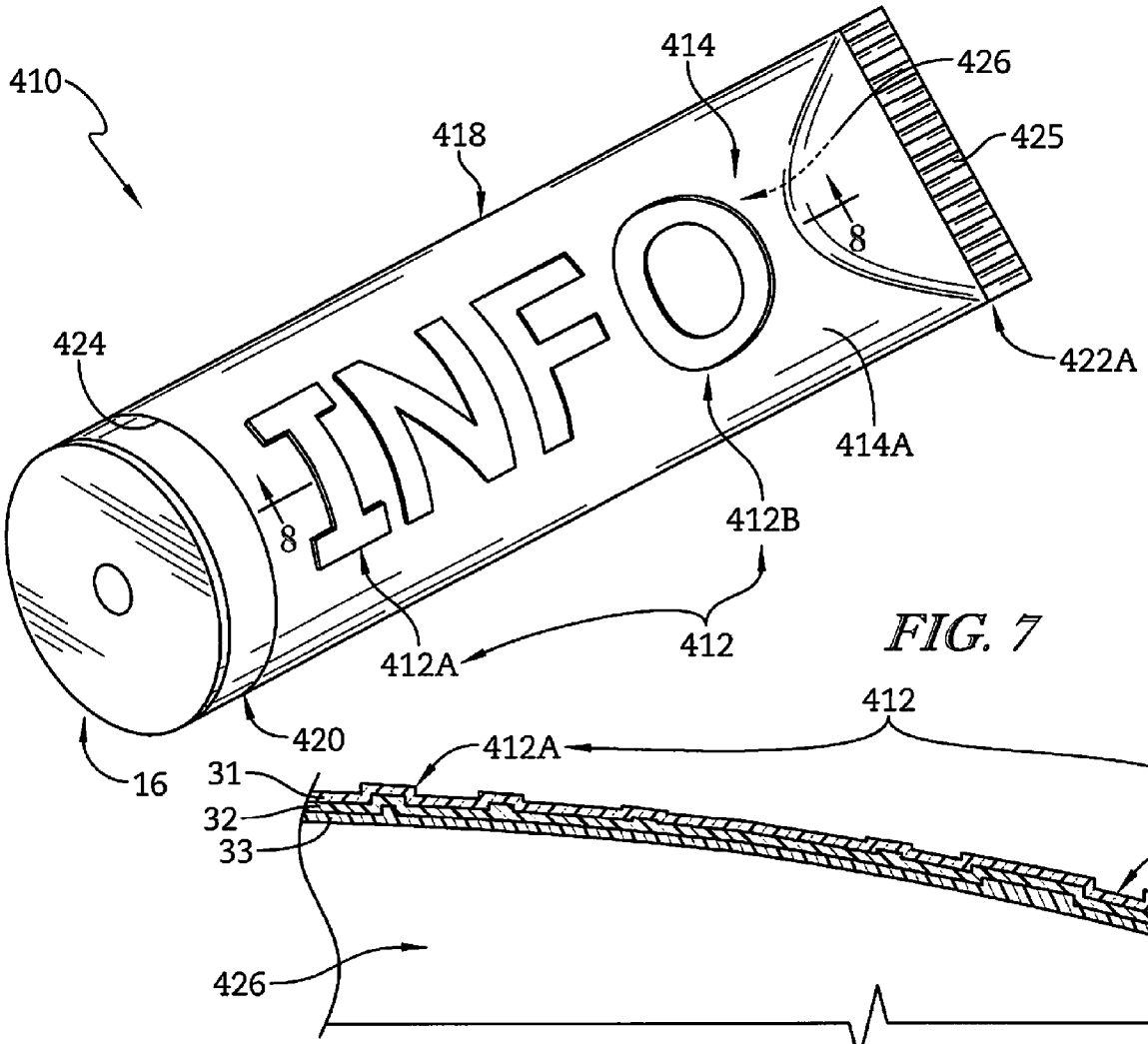
Figure 8:
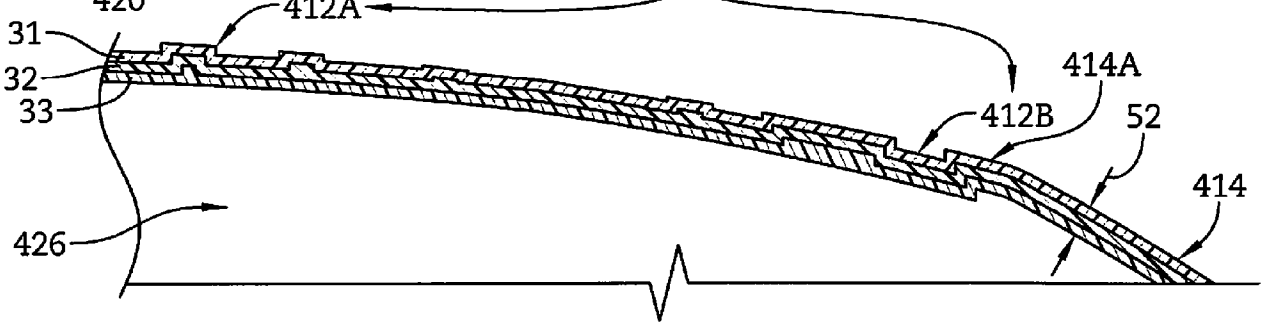

FIG. 3 is a diagrammatic view of a first embodiment of a manufacturing process used to make the squeeze tube of FIG. 1 showing that the manufacturing process includes providing a laminate sheet of plastics materials including multiple layers of plastics materials, printing graphics on the laminate sheet to form a printed sheet, embossing the printed sheet to form an embossed sheet, forming an embossed tube using the embossed sheet, cutting the embossed tube to form a sleeve, applying a closure to the sleeve to form an open package, and closing a tail end of the package to establish the squeeze tube of FIG. 1;

FIG. 4 is a diagrammatic view of a second embodiment of a manufacturing process used to make squeeze tube in accordance with the present disclosure showing that the manufacturing process includes providing a laminate sheet of plastics materials including multiple layers of plastics materials, printing graphics on the laminate sheet to form a printed sheet, embossing the printed sheet to form an embossed sheet, cutting the embossed sheet to form a container blank, forming a sleeve from the container blank, applying a closure to the sleeve to form an open package, and closing a tail end of the package to establish the squeeze tube;

FIG. 5 is a perspective view of a second embodiment of a squeeze tube in accordance with the present disclosure showing that the squeeze tube includes a recessed embossment, shown as INFO, formed during a manufacturing process;

FIG. 6 is a sectional view taken along line 6-6 of FIG. 5 showing the recessed embossment extends through all the layers of a multi-layer laminate included in the squeeze tube of FIG. 5;

FIG. 7 is a perspective view of a third embodiment of a squeeze tube in accordance with the present disclosure showing that the squeeze tube includes a fluid-discharge container and a fluid-discharge closure coupled to a head end of the fluid-storage container and that the fluid-storage container includes an embossment, shown as INFO, that includes a raised portion at the head end that transitions to a recessed portion at a tail end of the fluid-discharge container; and FIG. 8 is a sectional view taken along line 8-8 of FIG. 7 showing the embossment starts at the head end with a raised portion and transitions to a recessed portion at the tail end and that the embossment extends through all the layers of a multi-layer laminate included in the squeeze tube of FIG. 7.

DETAILED DESCRIPTION

A first embodiment of a squeeze tube 10 in accordance with the present disclosure and including a raised embossment 12 is shown in FIG. 1. A second embodiment of a squeeze tube 310 including a recessed embossment 312 is shown in FIG. 5. A third embodiment of a squeeze tube 410 including an embossment 412 including both a raised portion 412A and a recessed portion 412B is shown in FIG. 7. A first embodiment of a manufacturing process 100 for forming a squeeze tube including an embossment is shown in FIG. 3. A second embodiment of a manufacturing process 200 for forming a squeeze tube including an embossment is shown in FIG. 4.

Squeeze tube 10 includes a fluid-discharge closure 16 and a fluid-storage container 18 as shown in FIG. 1. Fluid-storage container 18 includes a head end 20 and an opposite tail end 22 as shown in FIG. 1. Fluid-storage container 18 is formed to include a mouth 24 at head end 20 that is arranged to open into a product-storage region 26 formed in fluid-storage container 18. Fluid-discharge closure 16 is coupled to fluid-storage container 18 to close mouth 24 and allow selective access to products located in product-storage region 26.

Fluid-storage container 18 includes a side wall 14, a tail-end closure 25, and raised embossment 12 as shown in FIG. 1. Side wall 14 is arranged in a cylindrical shape with tail-end closure 25 being formed during the manufacturing process at tail end 22. Embossment 12 is coupled to a non-embossed portion of side wall 14 and arranged to extend outwardly away from product-storage region 26 and the non-embossed portion of side wall 14 as shown in FIG. 2. During the manufacturing process, raised embossment 12 is formed as a result of permanently deforming a portion of a laminate sheet so as to cause embossment 12 to extend outwardly away from an outer surface 14A of the non-embossed portion of side wall 14. In one example, embossment 12 and the non-embossed portion of side wall 14 cooperate to establish a monolithic component.

Manufacturing process 100 is used to manufacture squeeze tube 10 as shown in FIG. 3. Manufacturing process 100 begins with a providing step 101 as shown in FIG. 3. During the providing step 101, multiple layers (e.g., three layers 31, 32, 33) are brought together to establish a laminate sheet 28. In one example, the multiple layers are brought together by co-extruding multiple layers to establish the laminate sheet. In another example, the multiple layers are coupled together via a lamination process. In another example, only one layer may be used thus providing a plastics-material sheet for use in manufacturing process 100 rather than laminate sheet 28.

In one example, laminate sheet 28 includes outer layer 31, an inner layer 33, and a core layer 32 as shown in FIGS. 2 and 3. Outer layer 31 is arranged in spaced-apart relation to inner layer 33 to locate core layer 32 therebetween. Outer layer 31 is configured to provide outer surface 14A arranged to face away from product-storage region 26 as shown in FIG. 2. In another example, a laminate sheet in accordance with the present disclosure has more than two layers. In an example, a laminate sheet in accordance with the present disclosure has five layers. In an example, a laminate sheet in accordance with the present disclosure has seven layers. In an example, a laminate sheet in accordance with the present disclosure has any suitable number of layers.

One or more of the layers included in laminate sheet 28 is made from plastics materials. It is within the scope of the present disclosure for one or more of the layers to be made of adhesive materials. In an example, the plastics materials include High Density Polyethylene (HDPE). In an example, the plastics materials include Linear Low Density Polyethylene (LLDPE). In an example, the plastics materials include an oxygen barrier such as Ethylene Vinyl Alcohol (EVOH), metallic foil, or any other suitable alternative. In an example, the plastics materials include combinations of HDPE, LLDPE, oxygen barriers, and adhesive materials.

In another example, the plastics materials includes a printed film. The printed film may have the printing on a side facing away from the other layers or on an opposite side facing toward the layer. When the printing is on the side facing the other layers, this is also known as a reverse printed film. In another example, the plastics materials include combinations of HDPE, LLDPE, oxygen barriers, adhesive materials, printed layers.

Process 100 then proceeds to a printing step 102 as shown in FIG. 3. During printing step 102, ink 54 is printed onto an outer surface 30 of laminate sheet 28. As a result, a printed sheet 34 is established as suggested in FIG. 3. Printing step 102 is performed on a printing machine 40 as shown in FIG. 3. It is within the scope of the present disclosure for printing step 102 to be omitted from process 100. Printing step 102 may be omitted, for example, when a printed film is included in the laminate sheet or no printing is desired on the squeeze tube.

Process 100 then proceeds to an embossing step 103 as shown in FIG. 3. During embossing step 103, a portion of printed sheet 34 is deformed through application of pressure to establish an embossed sheet 36 as shown in FIG. 3. In one example, embossing step 103 is performed without the application of heat. Embossed sheet 36 includes embossment 12 and a non-embossed portion 361 as shown in FIG. 3.

Embossing step 103 is performed on an embossing machine 38. Embossing machine 38, for example, includes an upper roller 381, a lower roller 382, an upper male die 383, and a lower female die 384. The upper male die 383 is coupled to move with upper roller 381 and has a pattern formed therein which extends outwardly away from upper roller 381 as suggested in FIG. 3. The lower female die 384 is coupled to lower roller 382 and formed to include a space which matches the pattern included in male die 383 as shown in FIG. 3. As printed sheet 34 moves between upper and lower rollers 381, 382, pressure is applied to printed sheet 34 causing a portion of printed sheet 34 to deform as shown in FIGS. 1 and 2 so that embossment 12 is provided.

In one example, embossment 12 has a thickness 58 that is measured from an outer surface 12S of embossment 12 to an outer surface 14A of the non-embossed portion of side wall 14 of open package 48 provided by outer surface 30 of plastics-material sheet 28. In one example, thickness 58 is less than about 0.05 inches. In another example, thickness 58 is less than about 0.04 inches. In another example, thickness 58 is less than about 0.035 inches. In a first set of ranges, thickness 58 is in a range of about, 0.01 inches to 0.05 inches, 0.02 inches to 0.05 inches, or about 0.03 inches to 0.05 inches. In a second set of ranges, thickness 58 is in a range of about 0.01 inches to 0.04 inches, about 0.02 inches to 0.04 inches, or about 0.03 inches to 0.04 inches. In another example, the thickness 58 is about 0.005, 0.01, 0.015, 0.02, 0.025, 0.03, 0.035, 0.04, 0.045, or 0.05 inches.

In an example where printing step 102 has occurred, embossment 12 may have thickness 58 less than about 0.04 inches. In a first set of ranges, thickness 58 is in a range of about 0.01 inches to 0.04 inches, about 0.02 inches to 0.04 inches, about 0.03 inches to 0.04 inches, or about 0.035 inches to 0.04 inches. In another example, the thickness 58 is about 0.005, 0.01, 0.015, 0.02, 0.025, 0.03, 0.035, 0.04 inches.

Just prior to embossing step 103, printed sheet 34 is aligned or registered with embossing machine 38 so as to cause the embossment formed by embossing machine 38 to be aligned with printing as desired. As a result, the printed graphics may be seen more easily and recognized more easily through the inclusion of a tactile input which is associated with the desired printing.

Process 100 then proceeds to a tube-forming step 104 as shown in FIG. 3. During tube-forming step 104, embossed sheet 36 is arranged to cause longitudinal edges 421, 422 to be overlapped and coupled together to establish an embossed tube 56 as shown in FIG. 3. Embossed tube 56 includes many sleeves 46 coupled together as suggested in FIG. 3

Process 100 then proceeds to a tube-cutting step 105 as shown in FIG. 3. During tube-cutting step 105, embossed tube 56 is cut to separate one sleeve 46 from the remaining sleeves included in embossed tube 56. In one example, each sleeve 46 is the monolithic component including the non-embossed portion of side wall 14 and embossment 12.

Process 100 then proceeds to a lidding step 106 as shown in FIG. 3. During lidding step 106, fluid-discharge closure 16 is coupled to head end 20 of sleeve 46 to close mouth 24 and establish an open package 48 as shown in FIG. 3. Tail end 22 of open package 48 is formed to include a fill aperture 50 arranged to open into product-storage region 26 as shown in FIG. 3. Lidding step 106 may also be called heading step 106.

Process 100 then proceeds to a capping step 107 as shown in FIG. 3. During capping step 107, products may be placed in product-storage region 26 and tail end 22 of open package 48 is closed and sealed together to close fill aperture 50. As a result, squeeze tube 10 is established.

Another embodiment of manufacturing process 200 in accordance with the present disclosure is shown in FIG. 4. Manufacturing process 200 begins with providing step 101 as shown in FIG. 4. During the providing step 101, multiple layers are brought together to establish the laminate sheet. In another example, only one layer may be used thus providing a plastics-material sheet for use in manufacturing process 200 rather than laminate sheet 28.

Process 200 then proceeds to printing step 102 as shown in FIG. 4. It is within the scope of the present disclosure for printing step 102 to be omitted from process 200.

Process 200 then proceeds to embossing step 103 as shown in FIG. 4. During embossing step 103, a portion of printed sheet 34 is deformed through application of pressure to establish an embossed sheet 36 as shown in FIG. 3. In one example, embossing step 103 is performed without the application of heat. Embossed sheet 36 includes embossment 12 and a non-embossed portion 361 as shown in FIG. 4.

Process 100 then proceeds to a cutting step 204 as shown in FIG. 4. During cutting step 204, embossed sheet 36 is cut to form a container blank 42 and scrap 44 as shown in FIG. 4. Scrap 44 may be retained for recycling or discarded as trash.

Process 200 then proceeds to a sleeve-forming step 205 as shown in FIG. 4. During sleeve-forming step 205, container blank 42 is arranged to cause longitudinal edge 421, 422 to be overlapped and coupled together to establish sleeve 46 as suggested in FIG. 4.

Process 200 then proceeds to lidding step 206 as shown in FIG. 4. During lidding step 206, fluid-discharge closure 16 is coupled to head end 20 of sleeve 46 to close mouth 24 and establish open package 48 as shown in FIG. 4. Tail end 22 of open package 48 is formed to include a fill aperture 50 arranged to open into product-storage region 26 as shown in FIG. 4. Lidding step 206 may also be called heading step.

Process 200 then proceeds to a capping step 207 as shown in FIG. 4. During capping step 207, products may be placed in product-storage region 26 and tail end 22 of open package 48 is closed and sealed together to close fill aperture 50. As a result, squeeze tube 10 is established. Capping step 207 may also be called filling step 207.

Side wall 14 has a wall thickness 52 as shown in FIG. 2. Wall thickness 52 is greater than a paper wall thickness. In one example, a paper wall thickness is about 0.001 inches to about 0.002 inches. Wall thickness 52 may be about ten times greater than a paper wall thickness. Wall thickness 52 is configured provide a feeling of thickness to a consumer while minimizing risk of puncture and fracture to side wall 14 after squeeze tube 10 is formed. As a result, it was found unexpectedly that printed sheet 34 having wall thickness 52 could be embossed despite the relatively greater thickness of wall thickness 52 compared to the paper wall thickness.

In one example, wall thickness 52 is about 0.01 inches to about 0.02 inches. In another example, wall thickness 52 is about 0.01 inches to about 0.015 inches. In another example, wall thickness 52 is about 0.012 inches to about 0.015 inches.

It was also unexpectedly found that embossment 12 of squeeze tube 10 maintained shape, size, and appearance over a period of time following embossing step 103. Embossment 12 resisted relaxing during storage and maintained size, shape, and appearance over time.

A second embodiment of a squeeze tube 310 in accordance with the present disclosure is shown, for example, in FIG. 5. Squeeze tube 310 includes fluid-discharge closure 16 and a fluid-storage container 318 as shown in FIG. 5. Fluid-storage container 318 includes a head end 320 and an opposite tail end 322 as shown in FIG. 5. Fluid-storage container 318 is formed to include a mouth 324 at head end 320 that is arranged to open into a product-storage region 326 formed in fluid-storage container 318. Fluid-discharge closure 16 is coupled to fluid-storage container 318 to close mouth 324 and allow selective access to products located in product-storage region 326.

Fluid-storage container 318 includes a tail-end closure 325 and a side wall 314 including a non-embossed portion and a recessed embossment 312 as shown in FIGS. 5 and 6. Side wall 314 is arranged in a cylindrical shape with tail-end closure 325 being formed during the manufacturing process at tail end 322. Recessed embossment 312 is coupled to the non-embossed portion of side wall 314 and arranged to extend inwardly into product-storage region 326 as shown in FIG. 6. During the manufacturing process, recessed embossment 312 is formed as a result of permanently deforming a portion of a laminate sheet so as to cause recessed embossment 312 to extend inwardly away from an outer surface 314A of the non-embossed portion of side wall 314.

A third embodiment of a squeeze tube 410 in accordance with the present disclosure is shown, for example, in FIG. 7. Squeeze tube 410 includes fluid-discharge closure 16 and a fluid-storage container 418 as shown in FIG. 7. Fluid-storage container 418 includes a head end 420 and an opposite tail end 422A as shown in FIG. 7. Fluid-storage container 418 is formed to include a mouth 424 at head end 420 that is arranged to open into a product-storage region 426 formed in fluid-storage container 418. Fluid-discharge closure 416 is coupled to fluid-storage container 418 to close mouth 424 and allow selective access to products located in product-storage region 426. Fluid-storage container 418 includes a tail-end closure 425 and a side wall 414 including a non-embossed portion and a combined embossment 412 as shown in FIGS. 7 and 8. Side wall 414 is arranged in a cylindrical shape with tail-end closure 425 being formed during the manufacturing process at tail end 422A. Combined embossment 412 is coupled to the non-embossed portion of side wall 414 and includes a raised portion 412A and a recessed portion 412B as shown in FIGS. 7 and 8. Raised portion 412A is arranged to extend outwardly away from product-storage region 426. Recessed portion 412B is arranged to extend inwardly into product-storage region 426 as shown in FIGS. 7 and 8. During the manufacturing process, combined embossment 412 is formed as a result of permanently deforming a portion of a laminate sheet so as to cause combined embossment 412 to extend both outwardly away from an outer surface 414A of side wall 414 and inwardly into product-storage region 426.

The invention claimed is:

1. A process of manufacturing an open package, the process comprising the steps of providing a metal-free multi-layer laminate plastics-material sheet having a first side and an opposite second side, embossing the metal-free multi-layer laminate plastics-material sheet to provide an embossed sheet including a non-embossed portion and an embossment coupled to the non-embossed portion and arranged to extend away from the non-embossed portion, and using the embossed sheet and a closure to establish an open package formed to include a fill aperture arranged to open into a product-storage region formed in the open package.

2. The process of claim 1, further comprising the step of printing an ink graphic onto the first side of the metal-free multi-layer laminate plastics-material sheet.

3. The process of claim 2, further comprising the step of aligning the ink graphic with the embossment.

4. The process of claim 3, wherein the embossment has a thickness measured from an outer surface of the embossment to an outer surface of the open package provided by the first side of the metal-free multi-layer laminate plastics-material sheet and the thickness is less than about 0.05 inches.

5. The process of claim 4, wherein the thickness is less than about 0.035 inches.

6. The process of claim 4, wherein the thickness is in a range of about 0.03 inches to about 0.04 inches.

7. The process of claim 6, wherein the thickness is about 0.035 inches.

8. The process of claim 1, further comprising the step of using the embossed sheet to establish an embossed tube.

9. The process of claim 8, further comprising the step of cutting the embossed tube to provide a sleeve formed to include the product-storage region therein, a mouth at a head end of the sleeve arranged to open into the product-storage region, and the fill aperture at an opposite tail end of the sleeve arranged to open into the product-storage region.

10. The process of claim 9, further comprising the step of coupling the closure to the head end of the sleeve to close the mouth and establish the open package.

11. The process of claim 1, wherein the metal-free multi-layer laminate plastics-material sheet includes plastics materials.

12. The process of claim 11, wherein the metal-free multi-layer laminate plastics-material sheet has a thickness greater than about 0.01 inches.

13. The process of claim 1, wherein the embossment is a raised embossment arranged to extend away from the product-storage region.

14. The process of claim 1, wherein the embossment is a recessed embossment arranged to extend into the product-storage region.

15. The process of claim 1, wherein the embossment includes a raised portion arranged to extend away from the product-storage region and a recessed portion arranged to extend into the product-storage region.

16. A squeeze tube comprising a container formed to include a product-storage region therein and a mouth arranged to open into the product-storage region, a closure coupled to the container to close the mouth and provide a first boundary of the product-storage region, wherein the container includes a side wall having an inner surface arranged to face toward the product-storage region and provide a second boundary of the product-storage region and an opposite outer surface arranged to face away from the product-storage region and a tail-end closure coupled to the side wall and configured to provide a third boundary of the product-storage region and the side wall includes an non-embossed portion and an embossment coupled to the non-embossed portion of the side wall, and wherein the side wall comprises a metal-free multi-layer laminate plastics-material sheet.

17. The squeeze tube of claim 16, wherein the embossment is a raised embossment arranged to extend outwardly away from the opposite outer surface of the non-embossed portion of the side wall and the product-storage region.

18. The squeeze tube of claim 17, wherein the non-embossed portion of the side wall and the embossment have a thickness greater than about 0.01 inches.

19. The squeeze tube of claim 18, wherein the embossment has a thickness that is less than about 0.05 inches.

20. The squeeze tube of claim 19, wherein the thickness of the embossment is in a range of about 0.03 inches to about 0.04 inches.

* * * * *